US008438706B2

(12) United States Patent
Brightman

(10) Patent No.: US 8,438,706 B2
(45) Date of Patent: May 14, 2013

(54) VACUUM PRESS FIT ZIPPER ASSEMBLY

(75) Inventor: Kent Harrison Brightman, Bethany Beach, DE (US)

(73) Assignee: Subzipper, Inc., Rogers, MN (US)

( * ) Notice: Subject to any disclaimer, the term of this patent is extended or adjusted under 35 U.S.C. 154(b) by 242 days.

(21) Appl. No.: 12/416,068

(22) Filed: Mar. 31, 2009

(65) Prior Publication Data

US 2009/0307880 A1 Dec. 17, 2009

Related U.S. Application Data

(60) Provisional application No. 61/072,628, filed on Mar. 31, 2008.

(51) Int. Cl.
*A44B 19/16* (2006.01)
*A44B 19/32* (2006.01)

(52) U.S. Cl.
USPC ..... 24/399; 24/428; 24/585.12; 24/584.1; 383/64

(58) Field of Classification Search ..... 24/399, 24/384, 389, 390, 400, 402, 406, 409, 432; 383/64
See application file for complete search history.

(56) References Cited

U.S. PATENT DOCUMENTS 3,440,696 A * 4/1969 Staller ..... 24/586.1
3,959,856 A * 6/1976 Ausnit ..... 24/399
5,007,142 A * 4/1991 Herrington ..... 24/400
5,138,750 A 8/1992 Gundlach et al.
5,638,587 A 6/1997 Martinez et al.
5,851,070 A 12/1998 Dobreski et al.
6,185,796 B1 2/2001 Ausnit
6,217,215 B1 * 4/2001 Tomic ..... 383/63
6,299,720 B1 10/2001 Van Erden
6,505,383 B2 * 1/2003 Machacek et al. ..... 24/30.5 R
6,550,111 B1 * 4/2003 Garraffa, Jr. ..... 24/399
6,581,253 B2 * 6/2003 ErkenBrack ..... 24/428
6,899,461 B2 * 5/2005 Kasai ..... 383/64
6,954,970 B2 * 10/2005 McMahon et al. ..... 24/428
6,964,519 B2 * 11/2005 ErkenBrack ..... 383/64
6,976,787 B2 * 12/2005 Plourde ..... 383/64
7,255,477 B2 * 8/2007 Arnell ..... 383/64
7,416,340 B2 * 8/2008 Schneider ..... 383/64
7,490,989 B2 * 2/2009 Kobetsky et al. ..... 383/64
7,849,565 B2 12/2010 Swain et al.
8,186,881 B2 5/2012 Lyon et al.
8,256,959 B2 * 9/2012 Hui et al. ..... 383/63
2004/0078940 A1 * 4/2004 Ishizaki ..... 24/400
2004/0141886 A1 * 7/2004 Py et al. ..... 422/102
2004/0187273 A1 * 9/2004 Meager ..... 24/399
2005/0251973 A1 * 11/2005 Sprehe ..... 24/399
2007/0071367 A1 * 3/2007 Buchman ..... 383/64
2007/0289108 A1 * 12/2007 Plourde et al. ..... 24/399

* cited by examiner

*Primary Examiner* — Robert J Sandy
*Assistant Examiner* — Rowland D Do
(74) *Attorney, Agent, or Firm* — Patton Boggs LLP

(57) ABSTRACT

A vacuum press fit zipper assembly designed for watersports apparel and gear and other water related applications. Overmolding construction forms an effective seal around the entire perimeter of the fastener assembly, and a vacuum fit is created between the two mating portions of the zipper assembly.

3 Claims, 3 Drawing Sheets

VACUUM PRESS FIT ZIPPER ASSEMBLY

CROSS REFERENCE TO RELATED APPLICATIONS

This application claims benefit of the filing date of 31 Mar. 2008, for the United States Provisional Patent Application to Brightman, having the Ser. No. 61/072,628.

BACKGROUND OF THE INVENTION

Standard zipper fasteners, like those typically found on garments and sportsgear, are great for their limited use as linear fasteners. However, they do not work well to prevent water from soaking through, even if the fabric of the garment itself is water resistant. There are extruded linear fasteners, such as is used with the trademarked Ziploc® food bags. Yet, the Ziploc® fastener, even with a slider, would not work well with garments and sports bags, mainly because the user would be unable to brace the fastener from within.

SUMMARY

The invention, in its simplest form, is a waterproof submersible vacuum-fit zipper or vacuum press fit zipper assembly. The zipper or zipper assembly is comprised of two mating parts forming the fastener assembly (see FIG. 3A) that, when engaged, create a partial vacuum (vacuum). When the partial vacuum is created, a watertight, airtight seal is formed. The two mating parts fit together with such precision, and with such robust design, that the assembly also prevents capillary action.

The mating parts are made of flexible elastomer-like material that can be produced through an extrusion, or injection molding process.

The unique design allows a watertight, airtight zipper to be easily engaged (closed) and then disengaged (opened) by way of pull tabs. The user simply slides the thumb and forefinger or slider the length of the zipper to close, and then pulls on the outside of the zipper via pull tabs to open.

This ease of use, flexible, watertight, airtight zipper design is useful in many water related applications, such as water sports apparel and gear.

DESCRIPTION OF DRAWING VIEWS

DETAILED DESCRIPTION

Figure 1:
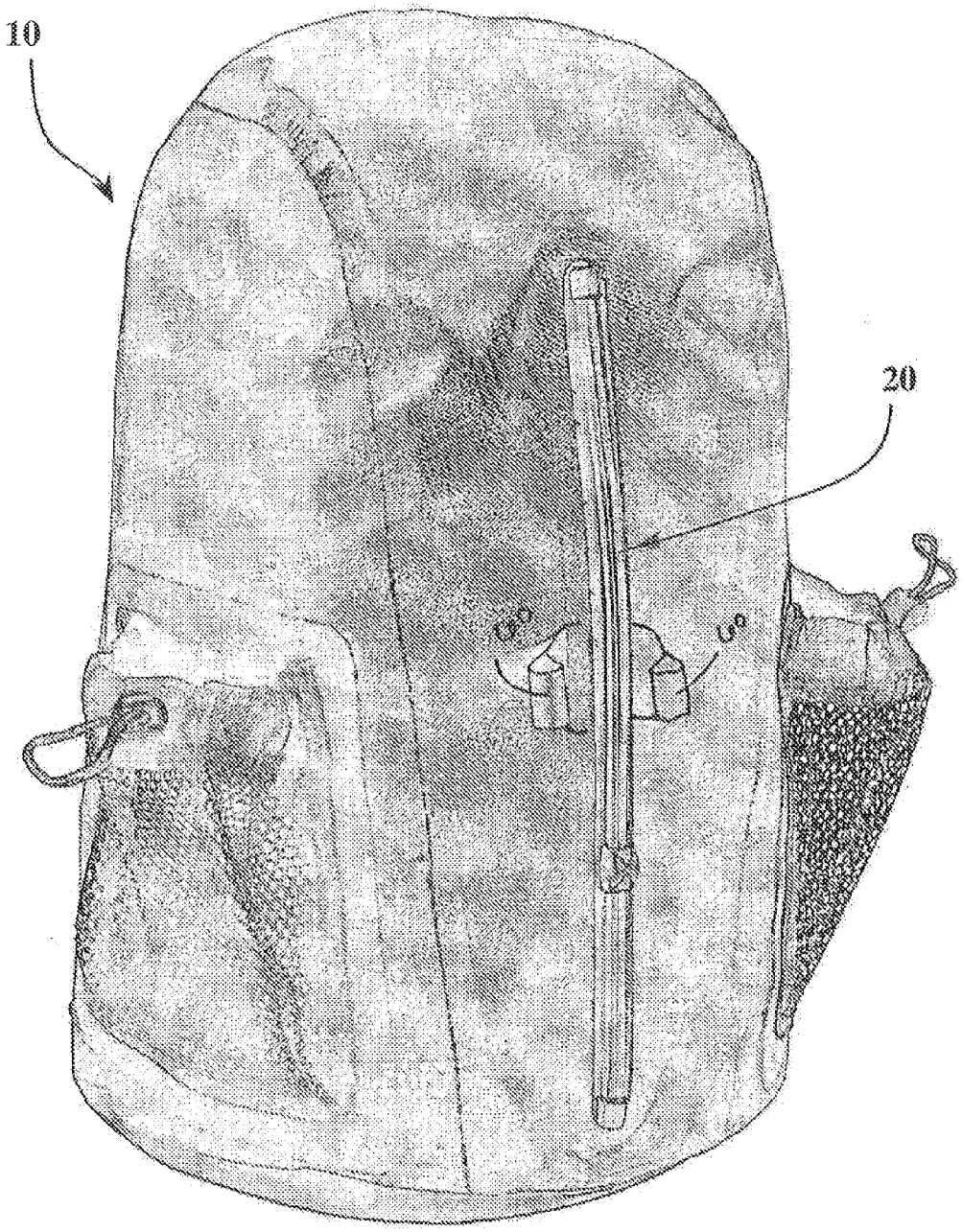
FIG. 1 is a perspective view of the invention in one of many possible embodiments.

FIG. 1 shows one embodiment of the invention, as it is integrated with a durable sports bag 10. The zipper assembly

20 has been radio frequency (RF) welded into place within the opening of the bag 10, to form a watertight product. The zipper assembly 20 is engineered and constructed in a way that it forms an effective seal around its entire perimeter, and between the two mating portions 30 and 31 as shown in FIG. 2.

Figure 2:
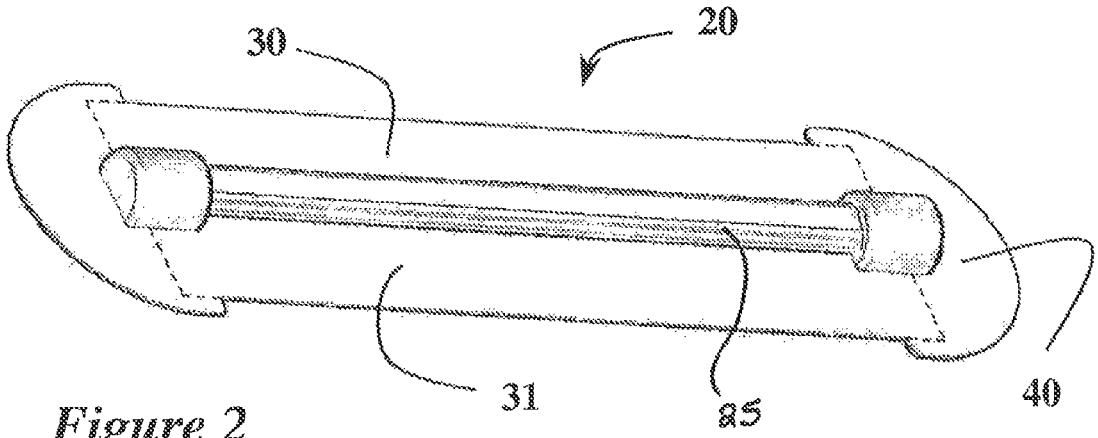
FIG. 2 is a close-up perspective view of the invention.

FIG. 2 shows the invention in its preferred embodiment. The zipper assembly 20 comprises a female extrusion 30, a male extrusion 31, and an over-molded end cap 40 at each end of the fastener assembly 25. (See FIG. 3 for a more detailed view of the extrusions 30 and 31, and FIG. 4 for a view from below the over-molded end cap 40.)

Figure 3A:
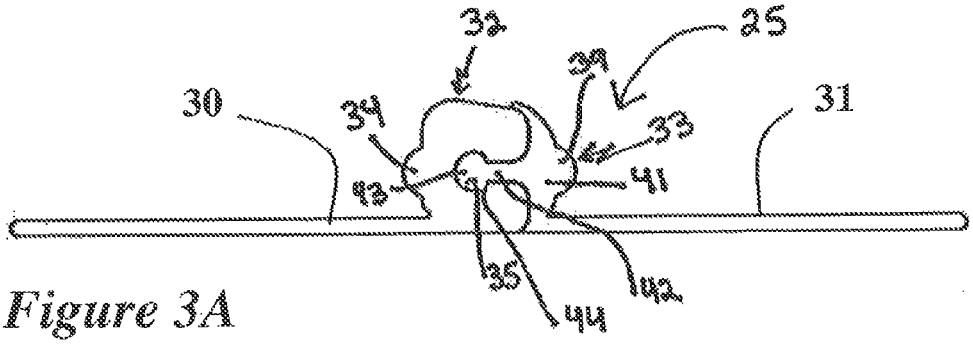
FIG. 3A is a very close-up end view of the extrusions that fasten together and are comprised by the invention.

Referring to FIG. 3A, the female extrusion 30 is shown joined with the male extrusion 31 such that the female member 32 and male member 33 engage each other, creating a partial vacuum (vacuum) there between. This precision fit permits a watertight, airtight seal that prevents capillary action from occurring.

Figure 3B:
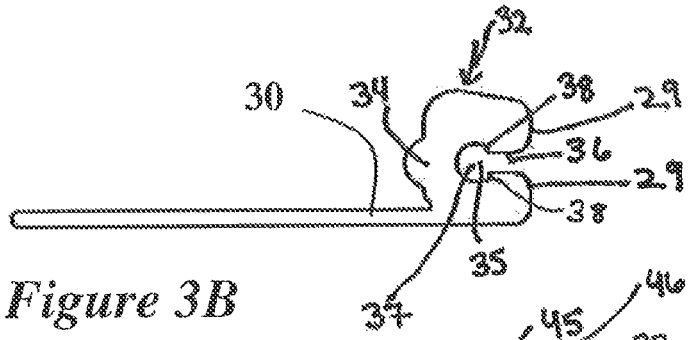
FIG. 3B is a very close-up end view of the female portion of the fastener.

More specifically, as shown in FIGS. 3A and 3B, female member 32 is of an upstanding C-like configuration having a slide extension or protrusion 34 formed on one side thereof, an interior cavity 35 formed in the interior opposite extension 34, and a pair of curved segments 29. This configuration is of a precise shape which forms the C-like configuration. An elongated entrance opening 36 terminates in an interior, bulb-like configurated opening 37. The socket configured opening 37 includes two flat interior surfaces 38 used to lock the male member 33 in place to assist in the creation of the vacuum within cavity 35 in a manner to be set forth below.

Reference is once again made to FIGS. 3A and 3C, where male member 33 of male extrusion 31 is depicted as an upstanding mating element. More specifically, male member 33 has a slide extension or protrusion 39 on an exterior surface of member 33 and a protruding member or protrusion 41. Protruding member 41 includes a stem 42 terminating in bulb or bulbous section 43. The bulbous section 43 has a pair of flat exterior surfaces 44 which are used to engage with interior flat surfaces 38, respectively to lock the bulbous section 43 within socket opening 37 creating a vacuum within cavity 35. Cup-like exterior segments 45 terminate in tips 46 so as to enable their tight fit to curved segments 29, respectively.

The female member 32 and male member 33 are made of a soft elastomeric-like material and must be precisely configured to approximately mate with one another. As the female member 32 and male member 33 engage each other to form the watertight, airtight seal, a vacuum or partial vacuum is found within cavity 35 as air leaves the cavity 35. Although it is possible to slide the female member 32 and male member 33 together to close the fastener assembly 25, fastening of fastener assembly 25 can also be accomplished when a slide 50 is used, which encompasses female member 32 and male member 33. Slide 50 is slid in one direction to close the fastener assembly 25 and then in the other direction after separating the female member 32 from the male member 33. Separation occurs when pull tabs 60 are used to pull apart the female and male members.

The material that forms the extrusions 30 and 31 and over-molded end cap 40 is a soft elastomer-like material, between 80-90 Shore A in hardness. Suitable materials include thermoplastic polyurethane (TPU) and polyvinyl chloride (PVC).

Note the dotted lines in FIG. 2, which indicate the locations where the end caps 40 are fused to the extrusions 30 and 31, during the over-molding process. The locations are shown as dotted lines because the zipper assembly 20 is practically seamless, and the surfaces of the end caps 40 match those of the extrusions 30 and 31, to form a single surface around the entire perimeter of the zipper assembly 20 above, and a single surface around the entire perimeter of the zipper assembly 20 below. This provides for a hermetic seal, and an attachment area that runs 360 degrees around the zipper assembly 20 for installment.

This is a unique use of the over-molding process for assembly, which allows parts to be butted together to form a flat and continuous surface between parts. This saves on material costs, and on mold tooling complexity. In this case, the flat surfaces formed into the invention allow the zipper assembly 20 to be bonded (in this case, RF welded) to the fabric of a garment or bag 10, so that a hermetic seal is possible between them. Overlapping portions, or material discontinuities, would otherwise make the step of complete sealing very difficult, if not impossible. In this usage, the over-molded end cap 40 uses the same material as the extrusions 30 and 31, which is of the same durometer/hardness, 80-90 Shore A.

FIG. 3A shows one end of both mating parts, as a fastened fastener assembly 25. The male and female extrusions 30 and 31 are extruded, in this case.

The fastener assembly 25 is secured with a mechanical "ball-and-socket" union (a combination of a press fit and an interference fit) as well as with a vacuum. The female member 32 of female extrusion 30 accepts the male member 33 of male extrusion 31 to form a precision fit and a vacuum-seal. The corresponding features shaped into each mating part 32 and 33 actually force all of the air out of the cavity 35 of fastener assembly 25, and creates what is called the vacuum-fit. This special fit resists separation, and bolsters the strength of the mechanical union between the two mating parts or extrusions 30 and 31 by mating surfaces 38 and 44.

Also, because all of the air is removed from between the two parts, female member 32 and male member 33, upon fastening, any capillary action that would otherwise fill voids or the cavity 35 with water (or other fluid) is prevented. Another hermetic seal is produced between the two extrusions 30 and 31.

FIG. 3B shows one of the female extrusions 30 by itself.

Figure 3C:
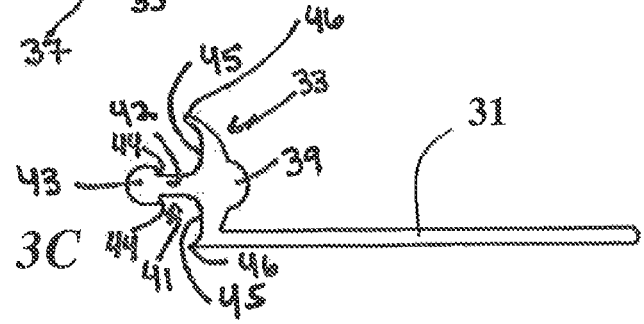
FIG. 3C is a very close-up end view of the male portion of the fastener.

FIG. 3C shows one of the male extrusions 31 by itself.

Figure 4:
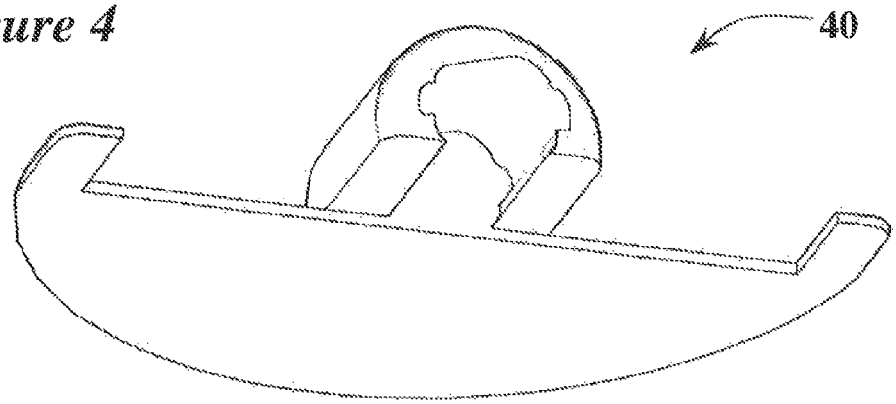
FIG. 4 is a very close-up perspective view of the over-molded end cap, which seals each end of the fastener.

FIG. 4 shows a view from below an end cap 40. The end cap 40 is over-molded, onto the end of the zipper assembly 20, to form yet another hermetic seal. In this view, a cavity is visible, where the assembly of two mating extrusions 30 and 31 fit together and are located upon molding. (The thickness of the flange on the end cap 40 is the same as the thickness of the flange of each of the extrusions 30 and 31).

Figure 5:
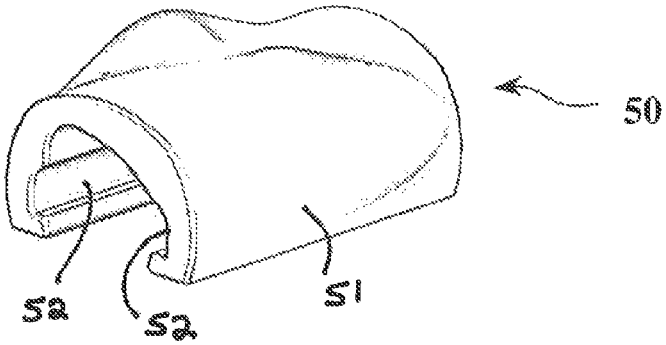
FIG. 5 is a very close-up perspective view of the slider, which is comprised by an alternate embodiment of the invention.

FIG. 5 shows a close-up view of the slider 50. This part is in the shape of a housing 51 having an internal tunnel-like configuration with a pair of oppositely disposed grooves or slots 52 which slideably mate with the opposed extensions or protrusions 34 and 39, respectively. Slider 50 may be snapped into place over the male and female members 32 and 33 of fastener assembly 25 at any time, once the extrusions 30 and 31 have been mated. Although the fastener assembly 25 may be closed by using two fingers alone, the slider 50 can be used instead. The fastener assembly 25 may then be opened by pulling the openers 60 (as shown in FIG. 1) in substantially opposite directions.

The slider 50 is injection-molded of a hard plastic with a low coefficient of friction, in this case, acetal with 20% polytetrafluoroethylene (PTFE) (Teflon®).

Figure 6:
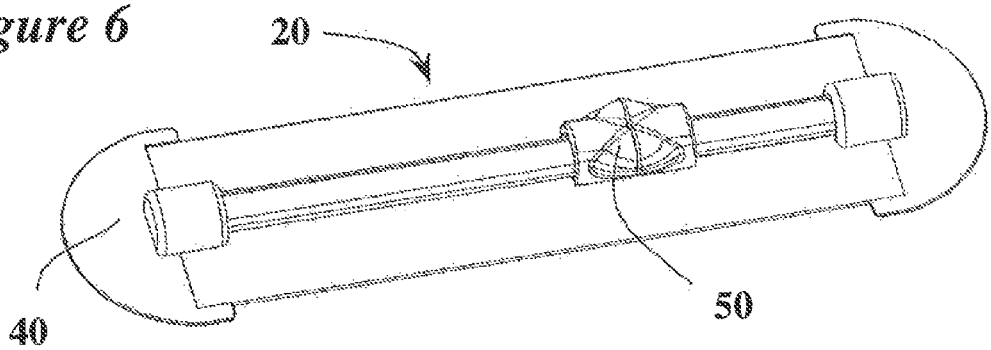
FIG. 6 is a close-up perspective view of an alternate embodiment of the invention, which comprises a slider to aid in fastening.

FIG. 6 shows an alternate embodiment of the zipper assembly 20, which includes the slider 50. This view also shows the end cap 40 on either end of the zipper assembly 20.

What is claimed is:

1. A watertight, vacuum press fit zipper assembly, comprising:

a fastener assembly made up of:

a female extrusion for matingly engaging a male extrusion to form a watertight, vacuum seal;

said female extrusion includes a substantially flat portion terminating in an upstanding female member extending therefrom, said female member having a C-like configuration with a slide extension protruding from an external surface thereof, said female member further having a cavity formed in the interior of the C-like configuration, said cavity extending from an elongated entrance opening and terminating in a bulbous or bulb-like opening forming a socket, the entrance opening of said cavity having opposed flat surfaces, and said C-like configuration having curved external portions extending from said flat surfaces;

said male extrusion includes a substantially flat portion terminating in an upstanding male member extending therefrom, said male member having a protruding stem on one side thereof and a slide extension protruding from an external surface on the other side thereof, said stem of said male member terminating in a bulbous or bulb-like section, the bulbous section having opposed flat surfaces, and having indentations that are reversely curved and terminating in tips to precisely mate with and cover the external curved portions of the female member to create a watertight, airtight seal; said bulbous section which protrudes from said stem of said male member is precisely shaped for matingly engaging with the bulbous-like cavity opening in the female member and creating a vacuum within said cavity and preventing capillary action from occurring when locked in place and when said flat surfaces of said female member and said male member, respectively, engage each other when said fastener assembly is closed;

a slider member for encompassing said female member and said male member, said slider member having internal opposed grooves therein for engaging said slide extensions on said female member and said male member, respectively; and at least one pull tab operably connected to at least said female extrusion or said male extrusion to aid in the opening of said fastener assembly.

2. The watertight, vacuum press fit zipper assembly as defined in claim 1 further comprising a pair of end caps, each of said pair of end caps secured to opposite ends of said fastener assembly.

3. The watertight, vacuum press fit zipper assembly as defined in claim 1 wherein said substantially flat portion of said female extrusion and said substantially flat portion of said male extrusion are matingly formed within a garment or bag to permit said garment or bag to be opened and closed with a watertight seal.

* * * * *